US006112897A

United States Patent [19]

Hu

[11] Patent Number: 6,112,897

[45] Date of Patent: Sep. 5, 2000

[54] TOOL HOLDERS

[76] Inventor: Bobby Hu, No. 6, Alley 235, Lane 75, Section 3, Kang Ning Road, Nei Hu District, Taipei, Taiwan

[21] Appl. No.: 09/134,949

[22] Filed: Aug. 17, 1998

[51] Int. Cl.[7] ..... B65D 85/28

[52] U.S. Cl. ..... 206/377; 206/372; 206/480; 211/70.6

[58] Field of Search ..... 206/376–379, 206/372, 478, 480, 482; 211/60.1, 69, 69.8, 70.6

[56] References Cited

U.S. PATENT DOCUMENTS

| | | | |
|---|---|---|---|
| 2,699,262 | 1/1955 | Elliott | 40/69.8 |
| 2,812,563 | 11/1957 | Barber | 40/60.1 |
| 3,822,783 | 7/1974 | Mortensen | 40/60.1 |
| 4,487,316 | 12/1984 | Calhoun et al. | 206/443 |
| 5,348,152 | 9/1994 | Kiyoshi et al. | 206/354 |
| 5,775,499 | 7/1998 | Budert | 206/379 |

*Primary Examiner*—Paul T. Sewell
*Assistant Examiner*—Nhan T. Lam
*Attorney, Agent, or Firm*—Charles E. Baxley, Esq.

[57] ABSTRACT

A tool holder includes a number of spaced holes. An inner periphery defining each hole includes a cutout defined therein. A periphery that defines each cutout includes a resilient retaining element projected therefrom. Each resilient retaining element has a portion projected into an associated hole.

4 Claims, 10 Drawing Sheets

TOOL HOLDERS

BACKGROUND OF THE INVENTION

1. Field of the Invention

The present invention relates to durable tool holders that may reliably retain tools in position.

2. Description of the Related Art

FIGS. 36 and 37 of the drawing a conventional tool holder 90 for hexagonal wrenches. Such a tool holder 90 includes a number of spaced holes 91 for receiving hexagonal wrenches, wherein a periphery defining each hole 91 includes a neck formed by two protrusions 92 for holding a hexagonal wrench. It is, nevertheless, found that the protrusions 92 are easily worn due to abrasion and thus loose their holding function as they are generally formed by plastic material. The present invention is intended to provide improved tool holders that are more durable to solve the above problem.

SUMMARY OF THE INVENTION

In accordance with one aspect of the invention, a tool holder comprises a plurality of spaced holes. An inner periphery defining each hole includes a cutout defined therein. A periphery that defines each cutout includes a resilient retaining element projected therefrom. Each resilient retaining element has a portion projected into an associated hole.

The periphery that defines each cutout includes two lateral walls, each lateral wall and an associated resilient retaining element having a slit defined therebetween. A distal end of each resilient retaining element and the periphery of the associated cutout have a second slit defined therebetween.

In accordance with a second aspect of the invention, a tool holder comprises a plurality of spaced holes. An inner periphery defining each hole includes two mutually facing cutouts defined therein. A periphery that defines each cutout includes a resilient retaining element projected therefrom. Each resilient retaining element has a portion projected into an associated hole.

In accordance with a third aspect of the invention, a tool holder comprises a plurality of spaced holes. A connecting wall that interconnects two adjacent holes has a cutout defined therein. A periphery that defines each cutout includes a resilient retaining element projected therefrom. Each resilient retaining element has a portion projected into one of the two adjacent holes.

Each cutout may be communicated with the two adjacent holes. The resilient retaining element includes two branches respectively projected into the two adjacent holes.

Each of two outermost holes may include a second cutout defined in an inner periphery thereof. A periphery that defines the second cutout includes a second resilient retaining element projected therefrom Each second resilient retaining element has a portion projected into an associated outermost hole.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
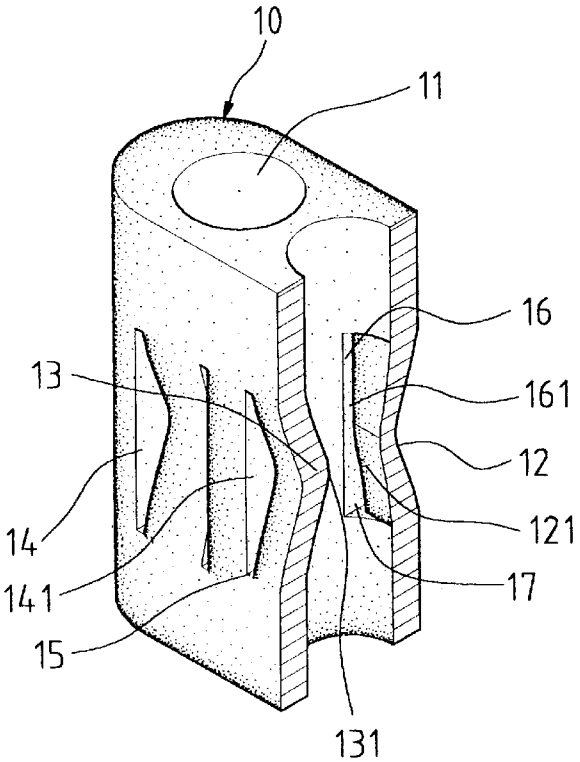
FIG. 1 is a perspective view, partly cutaway, of a first embodiment of a tool holder in accordance with the present invention.
Figure 2:
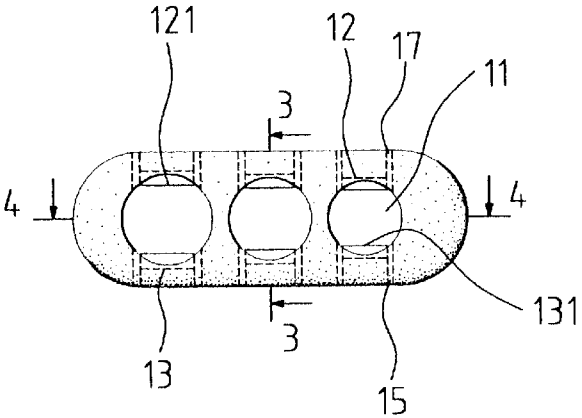
FIG. 2 is a top view of the tool holder in FIG. 1.
Figure 3:
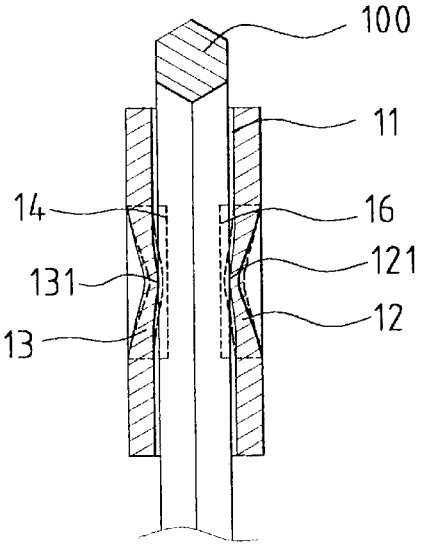
FIG. 3 is a sectional view taken along line 3—3 in FIG. 2.
Figure 4:
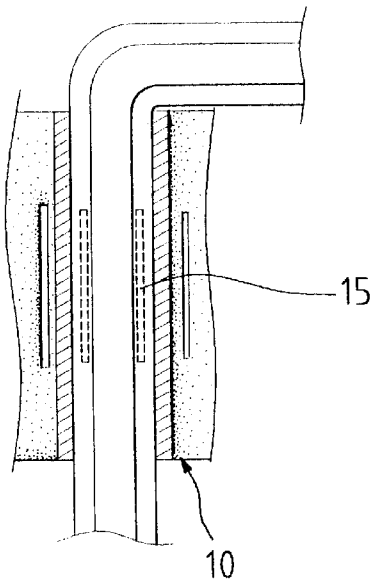
FIG. 4 is a sectional view taken along line 4—4 in FIG. 2.
Figure 5:
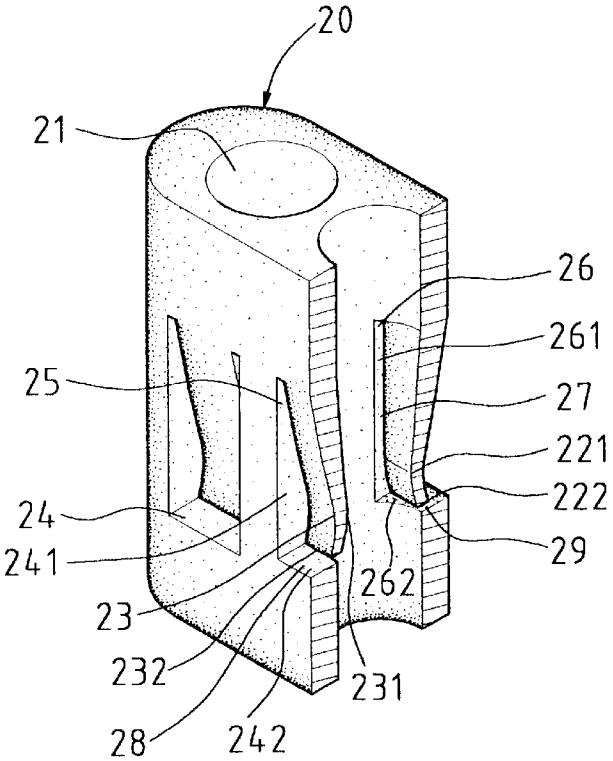
FIG. 5 is a perspective view, partly cutaway, of a second embodiment of the tool holder in accordance with the present invention.
Figure 6:
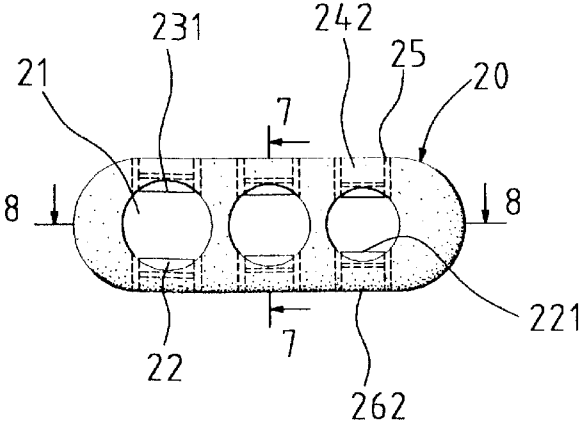
FIG. 6 is a top view of the tool holder in FIG. 5.
Figure 7:
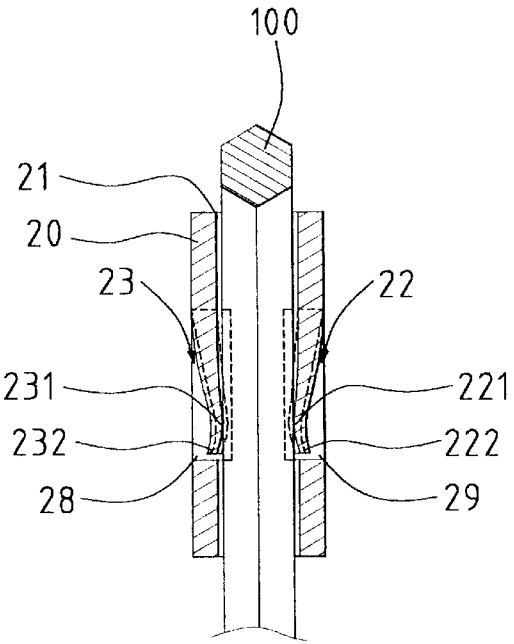
FIG. 7 is a sectional view taken along line 7—7 in FIG. 6.
Figure 8:
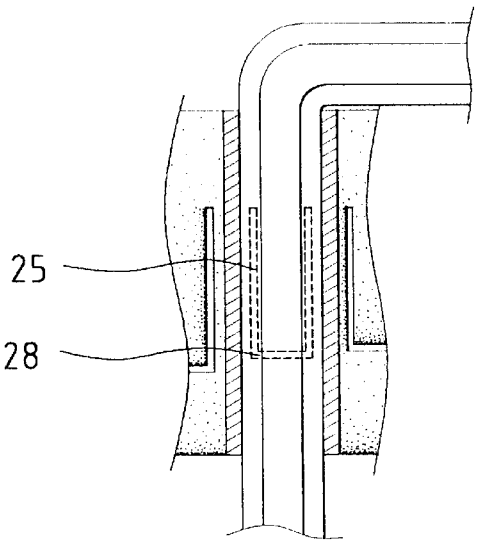
FIG. 8 is a sectional view taken along line 8—8 in FIG. 6.
Figure 9:
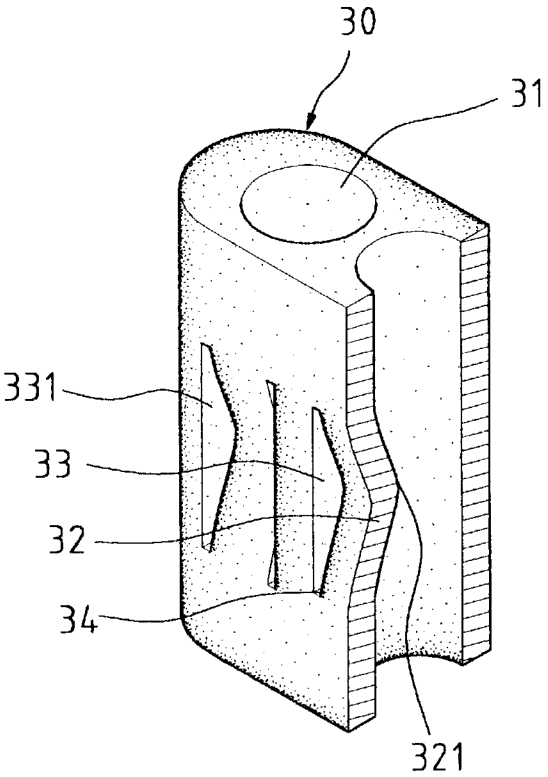
FIG. 9 is a perspective view, partly cutaway, of a third embodiment of the tool holder in accordance with the present invention.
Figure 10:
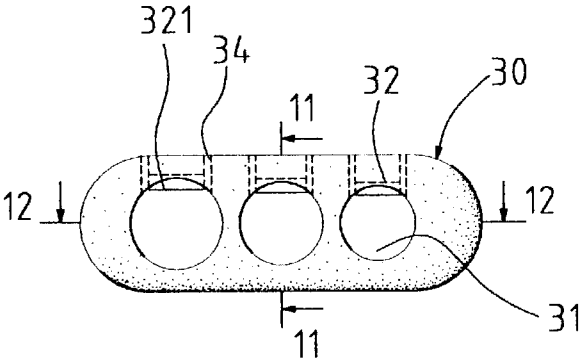
FIG. 10 is a top view of the tool holder in FIG. 9.
Figure 11:
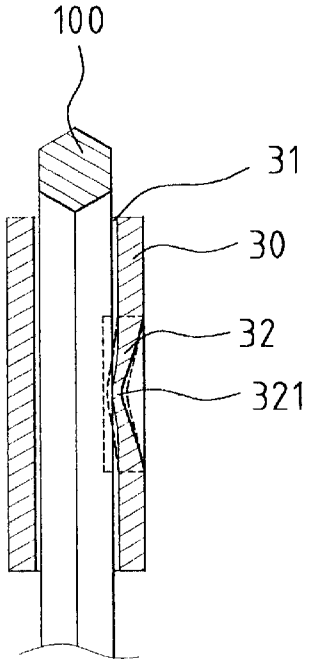
FIG. 11 is a sectional view taken along line 11—11 in FIG. 10.
Figure 12:
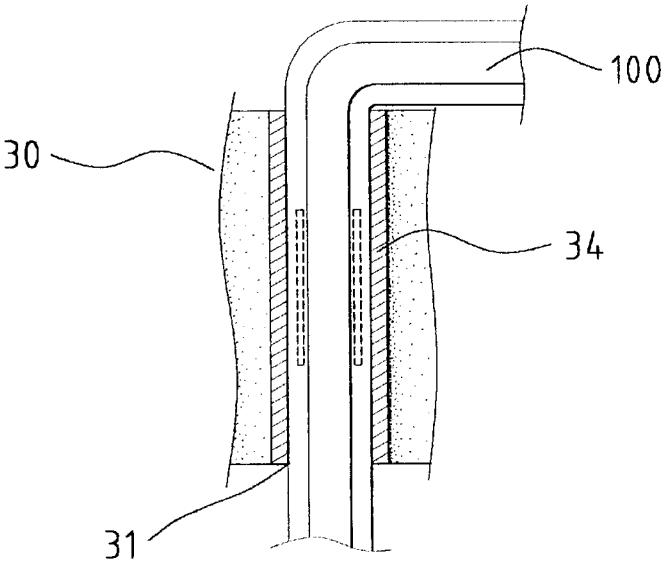
FIG. 12 is a sectional view taken along line 12—12 in FIG. 10.
Figure 13:
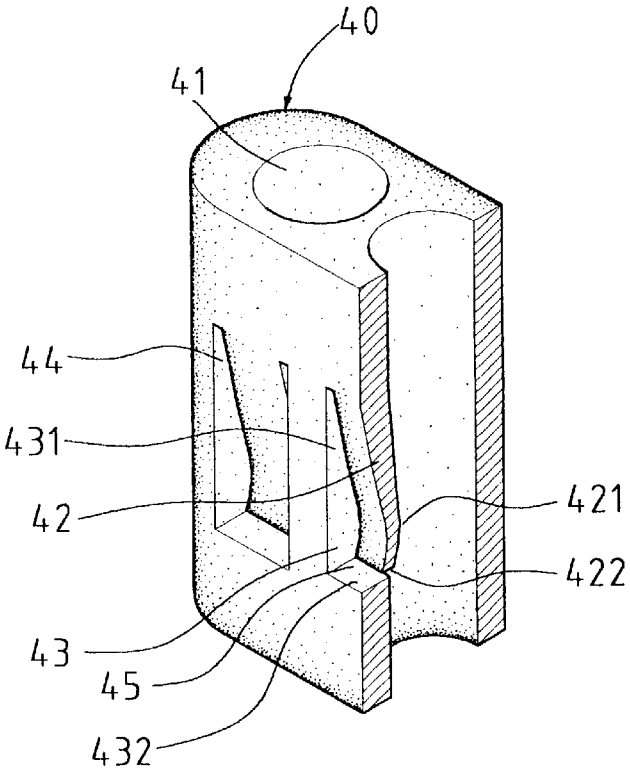
FIG. 13 is a perspective view, partly cutaway, of a fourth embodiment of the tool holder in accordance with the present invention.
Figure 14:
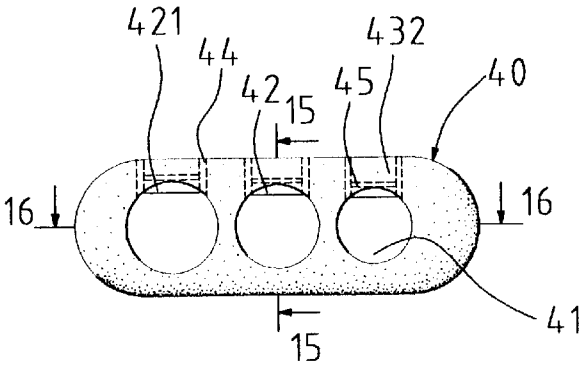
FIG. 14 is a top view of the tool holder in FIG. 13.
Figure 15:
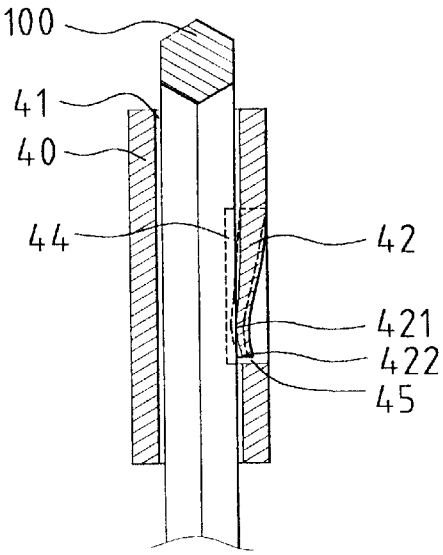
FIG. 15 is a sectional view taken along line 15—15 in FIG. 14.
Figure 16:
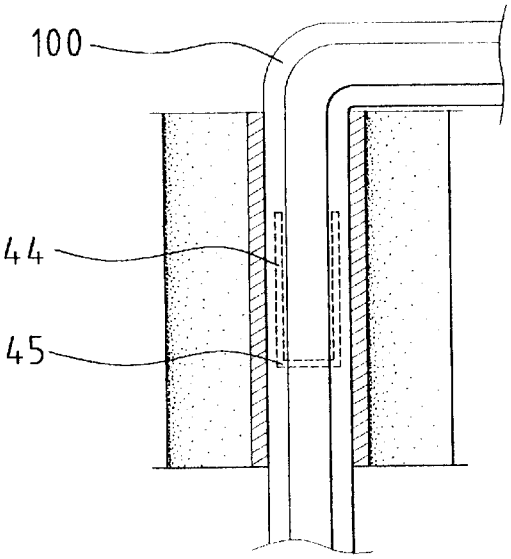
FIG. 16 is a sectional view taken along line 16—16 in FIG. 14.
Figure 17:
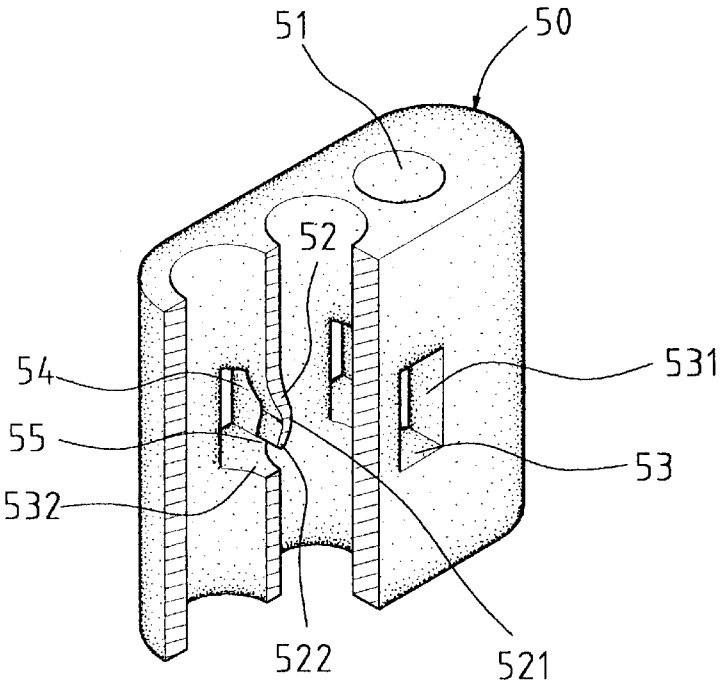
FIG. 17 is a perspective view, partly cutaway, of a fifth embodiment of the tool holder in accordance with the present invention.
Figure 19:
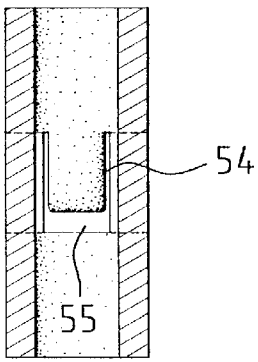
FIG. 19 is a sectional view taken along line 19—19 in FIG. 18.
Figure 18:
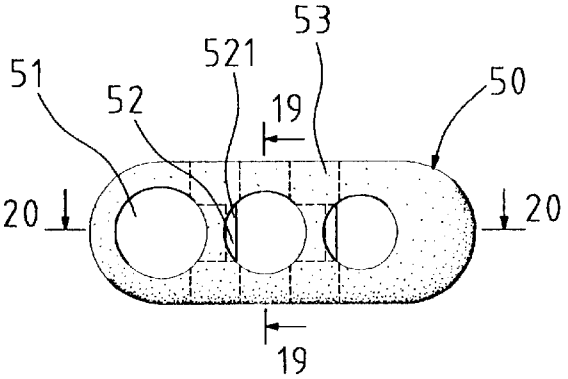
FIG. 18 is a top view of the tool holder in FIG. 17.

Referring to FIGS. 1 to 35 and initially to FIGS. 1 to 4, a first embodiment of a tool holder in accordance with the present invention is designated by reference numeral "10" and generally includes a plurality of spaced holes 11 defined therein. A periphery defining each hole 11 includes two mutually facing cutouts 14 and 16. Further, a periphery defining each cutout 14, 16 includes a resilient retaining element 13, 12 projected therefrom, the resilient retaining element 13, 12 having a portion 131, 121 projecting inwardly into an associated hole 11. In this embodiment, each resilient retaining element 13, 12 is substantially ">" shaped. In addition, each of two lateral walls 141, 161 that defines a portion of an associated cutout 14, 16 and the associated resilient retaining element 13, 12 have a slit 15, 17 defined therebetween.

In use, when a tool, e.g., a hexagonal wrench 100 is inserted into the hole 11, the resilient retaining elements 13 and 12 are slightly deformed and moved outwardly (FIG. 3) and may securely hold the hexagonal wrench 100. When the hexagonal wrench 100 is removed, the resilient retaining elements 13 and 12 return to their initial position. It is appreciated that the cutouts 14 and 16 allow deformation of the resilient retaining elements 13 and 12 without any damage or wear.

FIGS. 5 to 8 illustrate a second embodiment of the tool holder in accordance with the present invention. The tool holder is designated by reference numeral "20" and generally includes a plurality of spaced holes 21 defined therein. A periphery defining each hole 21 includes two mutually facing cutouts 24 and 26. Further, a periphery defining each cutout 24, 26 includes a resilient retaining element 23, 22 projected therefrom, the resilient retaining element 23, 22 having a portion 231, 221 projecting inwardly into an associated hole 21. In this embodiment, each resilient retaining element 23, 22 is substantially "J" shaped. In addition, each of two lateral walls 241, 261 that defines a portion of an associated cutout 24, 26 and the associated resilient retaining element 23, 22 have a slit 15, 17 defined therebetween. Further, each resilient retaining element 23, 22 includes a distal end 232, 222 not connected with an end wall 242, 222 that defines a portion of the associated cutout 24, 26. Namely, a slit 28, 29 is defined between the distal end 232, 222 of the resilient retaining element 23, 22 and the associated end wall 242, 222.

In use, when a tool, e.g., a hexagonal wrench 100 is inserted into the hole 21, the resilient retaining elements 23 and 22 are slightly deformed and moved outwardly (FIG. 7) and may securely hold the hexagonal wrench 100. When the hexagonal wrench 100 is removed, the resilient retaining elements 23 and 22 return to their initial position. It is appreciated that the cutouts 24 and 26 allow deformation of the resilient retaining elements 23 and 22 without any damage or wear.

FIGS. 9 to 12 illustrate a third embodiment of the tool holder in accordance with the present invention. The tool holder is designated by reference numeral "30" and generally includes a plurality of spaced holes 31 defined therein. In this embodiment, a periphery defining each hole 11 includes a cutout 33. Further, a periphery defining each cutout 34 includes a resilient retaining element 32 projected therefrom, the resilient retaining element 32 having a portion 321 projecting inwardly into an associated hole 11. In this embodiment, each resilient retaining element 32 is substantially ">" shaped. In addition, each of two lateral walls 331 that defines a portion of an associated cutout 33 and the associated resilient retaining element 32 have a slit 25, 27 defined therebetween.

In use, when a tool, e.g., a hexagonal wrench 100 is inserted into the hole 31, the resilient retaining element 32 is slightly deformed and moved outwardly (FIG. 11) and may securely hold the hexagonal wrench 100. When the hexagonal wrench 100 is removed, the resilient retaining element 32 returns to its initial position. It is appreciated that the cutout 33 allows deformation of the resilient retaining element 32 without any damage or wear.

FIGS. 13 to 16 illustrate a fourth embodiment of the tool holder in accordance with the present invention. The tool holder is designated by reference numeral "40" and generally includes a plurality of spaced holes 41 defined therein. A periphery defining each hole 41 includes a cutout 43. Further, a periphery defining each cutout 43 includes a resilient retaining element 42 projected therefrom, the resilient retaining element 42 having a portion 421 projecting inwardly into an associated hole 41. In this embodiment, each resilient retaining element 42 is substantially "J" shaped. In addition, each of two lateral walls 431 that defines a portion of an associated cutout 43 and the associated resilient retaining element 42 have a slit 44 defined therebetween. Further, each resilient retaining element 42 includes a distal end 422 that is not connected with an end wall 432 that defines a portion of the associated cutout 43. Namely, a slit 45 is defined between the distal end 422 of the resilient retaining element 42 and end wall 432 of the associated cutout 43.

In use, when a tool, e.g., a hexagonal wrench 100 is inserted into the hole 41, the resilient retaining element 42 is slightly deformed and moved outwardly (FIG. 15) and may securely hold the hexagonal wrench 100. When the hexagonal wrench 100 is removed, the resilient retaining element 42 returns to its initial position. It is appreciated that the cutout 43 allows deformation of the resilient retaining element 42 without any damage or wear.

Figure 20:
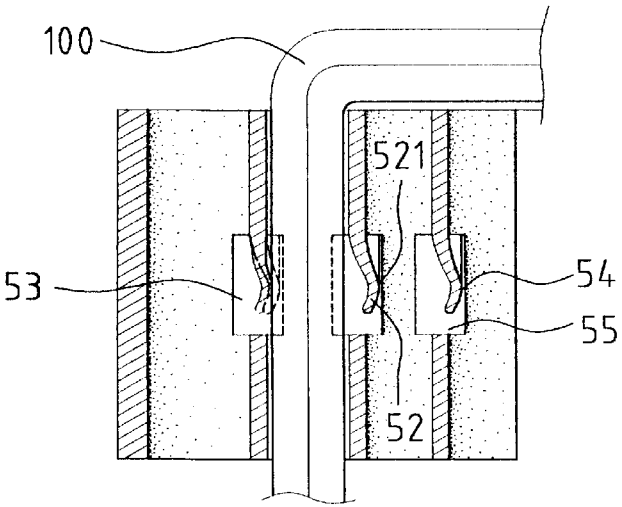
FIG. 20 is a sectional view taken along line 20—20 in FIG. 18.
Figure 21:
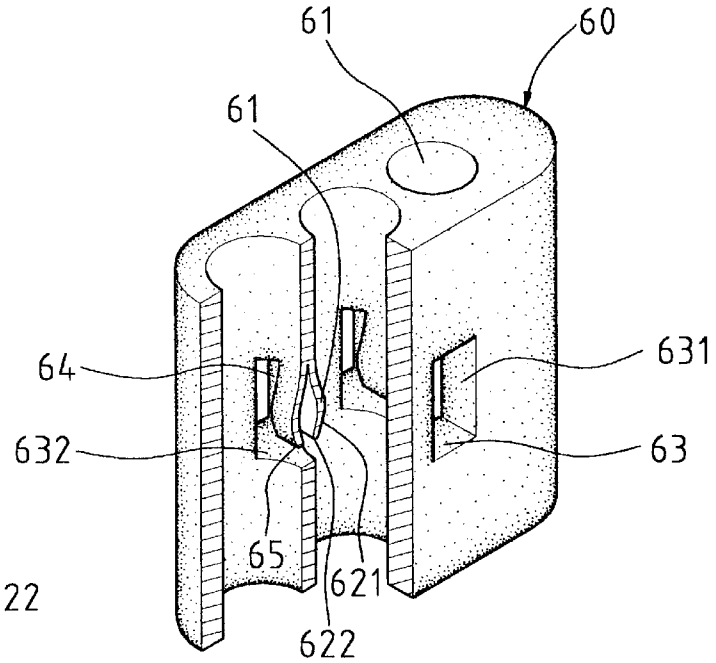
FIG. 21 is a perspective view, partly cutaway, of a sixth embodiment of the tool holder in accordance with the present invention.
Figure 23:
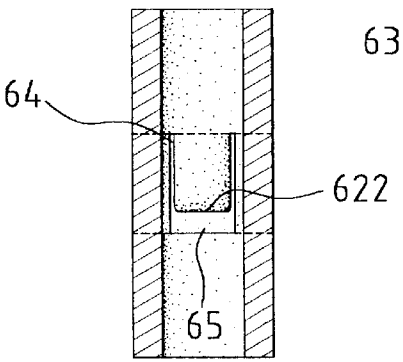
FIG. 23 is a sectional view taken along line 23—23 in FIG. 22.
Figure 22:
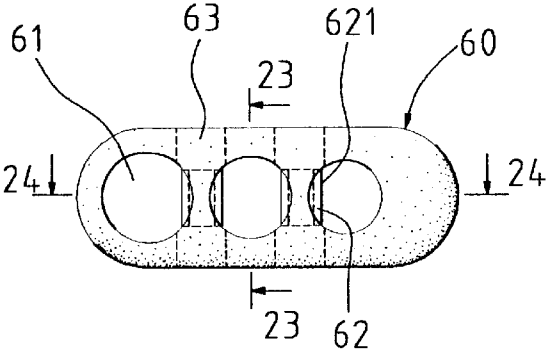
FIG. 22 is a top view of the tool holder in FIG. 21.

FIGS. 17 to 20 illustrate a fifth embodiment of the tool holder in accordance with the present invention. The tool holder is designated by reference numeral "50" and generally includes a plurality of spaced holes 51 defined therein. A cutout 53 is defined in a connecting wall that interconnects two adjacent holes 51. In this embodiment, the cutout 53 extends to two lateral sides of the tool holder 50 to allow easy manufacture. As shown in FIG. 20, a periphery defining each cutout 53 includes a resilient retaining element 52 projected therefrom, the resilient retaining element 52 having a portion 521 projecting inwardly into one of the associated holes 51. In this embodiment, each resilient retaining element 53 is substantially "J" shaped. In addition, each of two lateral walls 531 that defines a portion of an associated cutout 53 and the associated resilient retaining element 52 have a slit 54 defined therebetween. Further, each resilient retaining element 52 includes a distal end 522 not connected with an end wall 532 that defines a portion of the associated cutout 53. Namely, a slit 55 is defined between the resilient retaining element 52 and the end wall 532 of the associated cutout 53.

In use, when a tool, e.g., a hexagonal wrench 100 is inserted into the hole 51, the resilient retaining element 52 is slightly deformed and moved outwardly (FIG. 20) and may securely hold the hexagonal wrench 100. When the hexagonal wrench 100 is removed, the resilient retaining element 52 returns to its initial position. It is appreciated that the cutout 53 allows deformation of the resilient retaining element 52 without any damage or wear.

Figure 24:
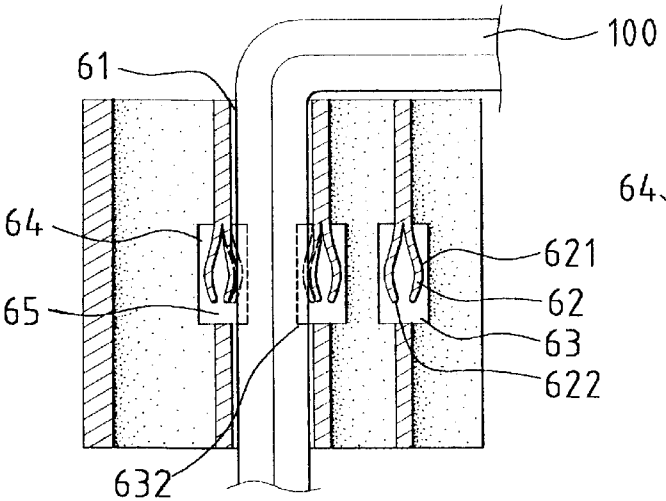
FIG. 24 is a sectional view taken along line 24—24 in FIG. 22.
Figure 25:
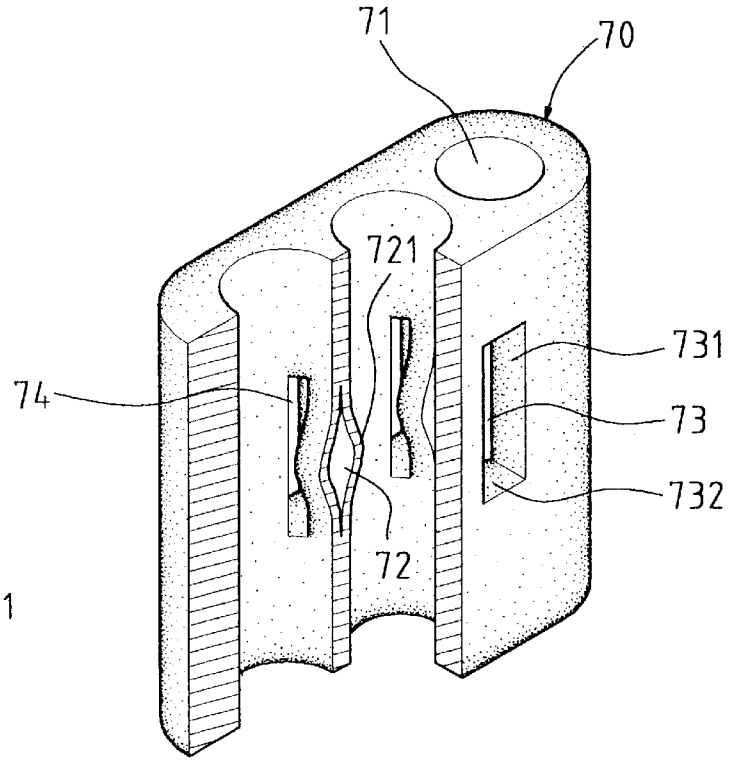
FIG. 25 is a perspective view, partly cutaway, of a seventh embodiment of the tool holder in accordance with the present invention.
Figure 26:
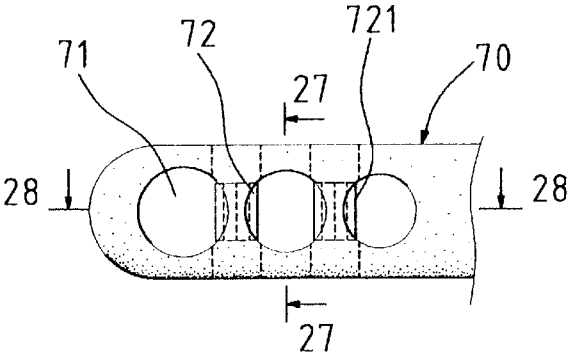
FIG. 26 is a top view of the tool holder in FIG. 25.
Figure 27:
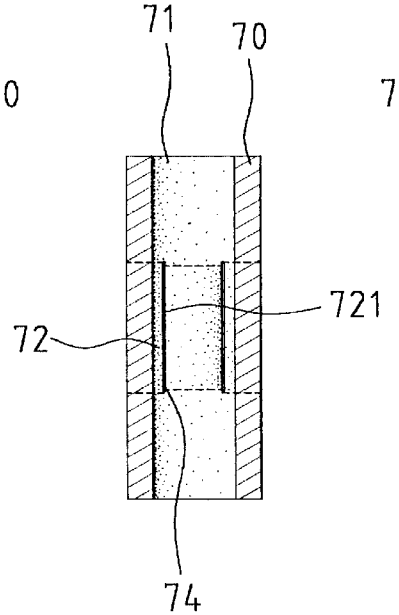
FIG. 27 is a sectional view taken along line 27—27 in FIG. 26.

FIGS. 21 to 24 illustrate a sixth embodiment of the tool holder in accordance with the present invention. The tool holder is designated by reference numeral "60" and generally includes a plurality of spaced holes 61 defined therein. A cutout 63 is defined in a connecting wall that interconnects two adjacent holes 61. In this embodiment, the cutout 63 extends to two lateral sides of the tool holder 60 to allow easy manufacture. As shown in FIG. 24, a periphery defining each cutout 63 includes a resilient retaining element 62 projected therefrom and having two branches (not labeled), each branch having a portion 621 projecting inwardly into each one of the associated holes 61. In this embodiment, each resilient retaining element 62 is substantially "Λ" shaped. In addition, each of two lateral walls 631 that defines a portion of an associated cutout 63 and the associated resilient retaining element 62 have a slit 64 defined therebetween. Further, each branch of each resilient retaining element 62 includes a distal end 622 not connected with an end wall 632 that defines a portion of the associated cutout 63. Namely, a slit 65 is defined between the distal end 622 of each branch of the resilient retaining element 62 and the end wall 632 of the associated cutout 63.

In use, when a tool, e.g., a hexagonal wrench 100 is inserted into the hole 61, the resilient retaining elements 62 are slightly deformed and moved outwardly (FIG. 24) and may securely hold the hexagonal wrench 100. When the hexagonal wrench 100 is removed, the resilient retaining elements 62 return to their initial positions. It is appreciated that the cutouts 63 allow deformation of the resilient retaining element 62 without any damage or wear.

Figure 28:
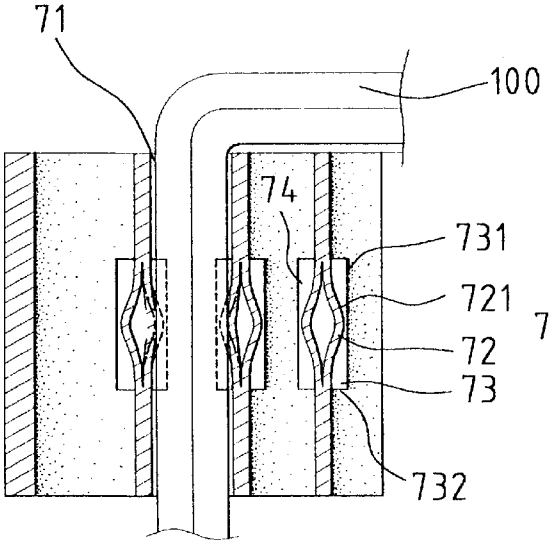
FIG. 28 is a sectional view taken along line 28—28 in FIG. 26.
Figure 29:
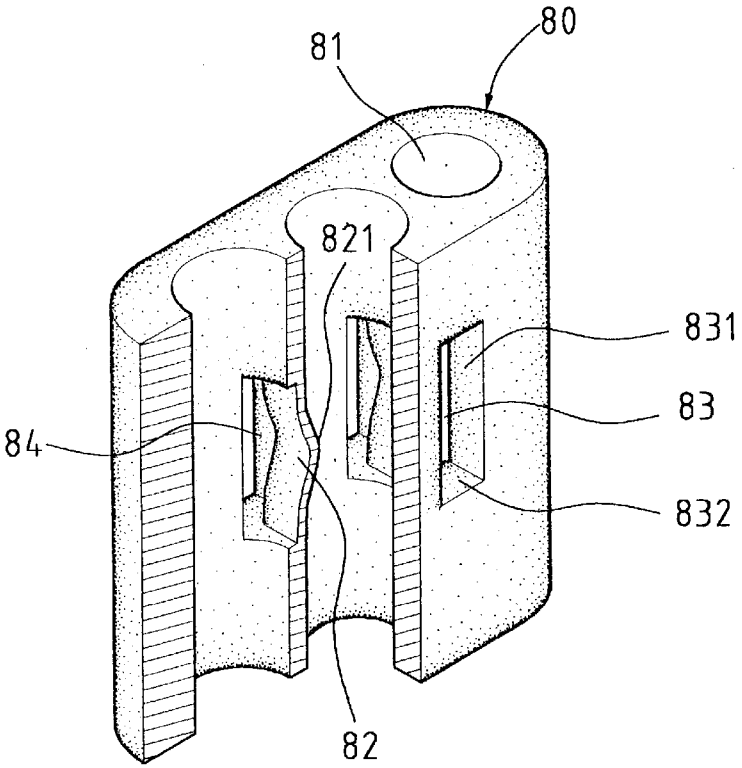
FIG. 29 is a perspective view, partly cutaway, of an eighth embodiment of the tool holder in accordance with the present invention.
Figure 30:
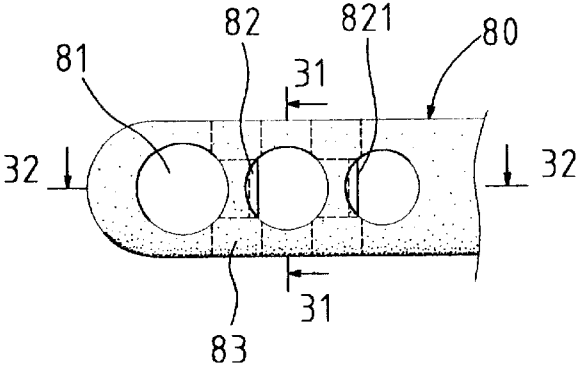
FIG. 30 is a top view of the tool holder in FIG. 29.
Figure 31:
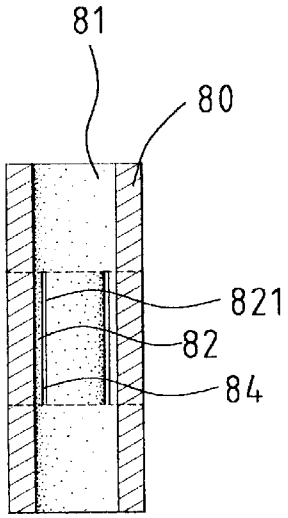
FIG. 31 is a sectional view taken along line 31—31 in FIG. 30.

FIGS. 25 to 28 illustrate a seventh embodiment of the tool holder in accordance with the present invention. The tool holder is designated by reference numeral "70" and generally includes a plurality of spaced holes 71 defined therein. A cutout 73 is defined in a connecting wall that interconnects two adjacent holes 71. In this embodiment, the cutout 73 extends to two lateral sides of the tool holder 70 to allow easy manufacture. As shown in FIG. 28, a periphery defining each cutout 73 includes a resilient retaining element 72 projected therefrom and having two branches, each branch having a portion 721 projecting inwardly into each one of the associated holes 71. In this embodiment, each resilient retaining element 72 is substantially "◇" shaped. In addition, each of two lateral walls 731 that defines a portion of an associated cutout 73 and the associated resilient retaining element 72 have a slit 74 defined therebetween. Further, each branch of each resilient retaining element 72 includes a distal end (not labeled) connected with an end wall 732 that defines a portion of the associated cutout 73.

In use, when a tool, e.g., a hexagonal wrench 100 is inserted into the hole 71, the resilient retaining elements 72 is slightly deformed and moved outwardly (FIG. 28) and may securely hold the hexagonal wrench 100. When the hexagonal wrench 100 is removed, the resilient retaining elements 72 return to their initial positions. It is appreciated that the cutout 73 allows deformation of the resilient retaining element 72 without any damage or wear.

Figure 32:
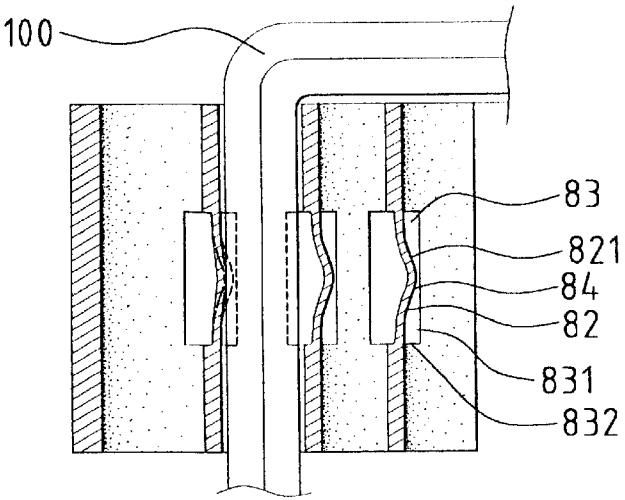
FIG. 32 is a sectional view taken along line 32—32 in FIG. 30.

FIGS. 29 to 32 illustrate an eighth embodiment of the tool holder in accordance with the present invention. The tool holder is designated by reference numeral "80" and generally includes a plurality of spaced holes 81 defined therein. A cutout 83 is defined in a connecting wall that interconnects two adjacent holes 81. In this embodiment, the cutout 83 extends to two lateral sides of the tool holder 80 to allow easy manufacture. As shown in FIG. 32, a periphery defining each cutout 83 includes a resilient retaining element 82 projected therefrom and having a portion 821 projecting inwardly into one of the associated holes 81. In this embodiment, each resilient retaining element 82 is substantially "(" shaped. In addition, each of two lateral walls 831 that defines a portion of an associated cutout 83 and the associated resilient retaining element 82 have a slit 84 defined therebetween. Further, each resilient retaining element 82 includes a distal end (not labeled) connected with an end wall 832 that defines a portion of the associated cutout 83.

In use, when a tool, e.g., a hexagonal wrench 100 is inserted into the hole 81, the resilient retaining elements 82 is slightly deformed and moved outwardly (FIG. 32) and may securely hold the hexagonal wrench 100. When the hexagonal wrench 100 is removed, the resilient retaining element 82 returns to its initial position. It is appreciated that the cutout 83 allows deformation of the resilient retaining element 82 without any damage or wear.

Figure 33:
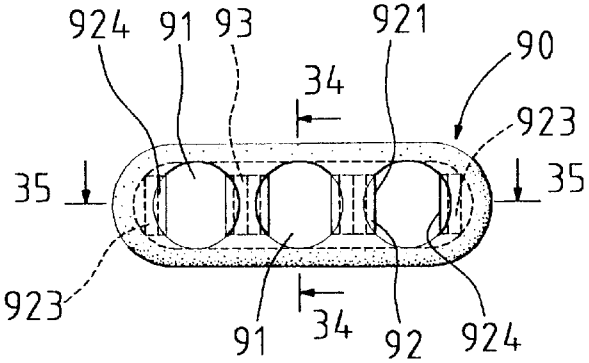
FIG. 33 is a top view of a ninth embodiment of the tool holder in accordance with the present invention.
Figure 34:
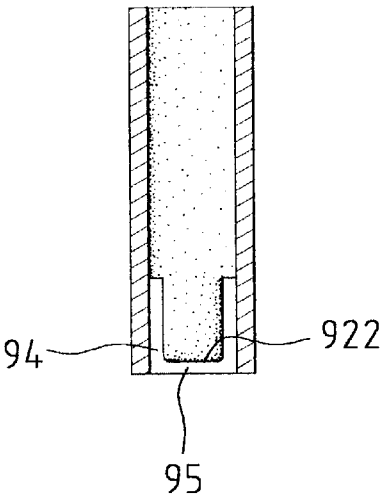
FIG. 34 is a sectional view taken along line 34—34 in FIG. 33.
Figure 35:
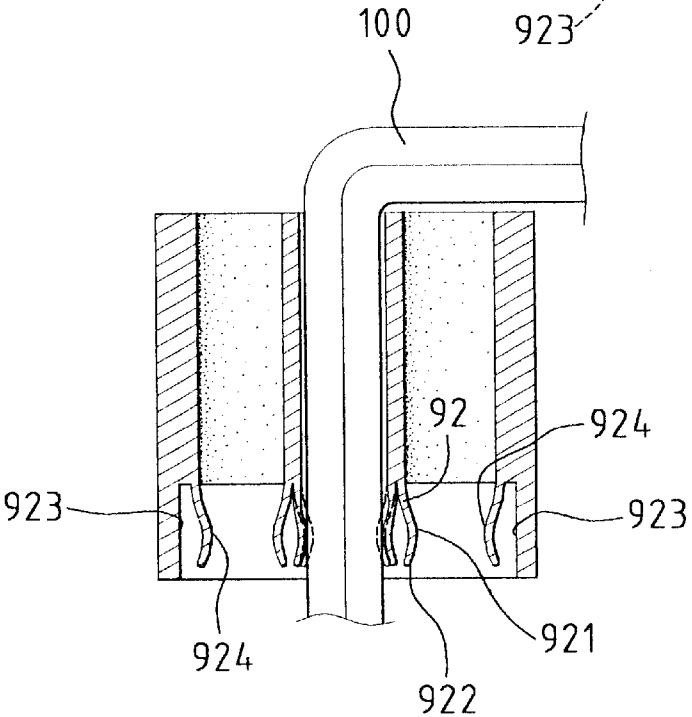
FIG. 35 is a sectional view taken along line 35—35 in FIG. 33.
Figure 36:
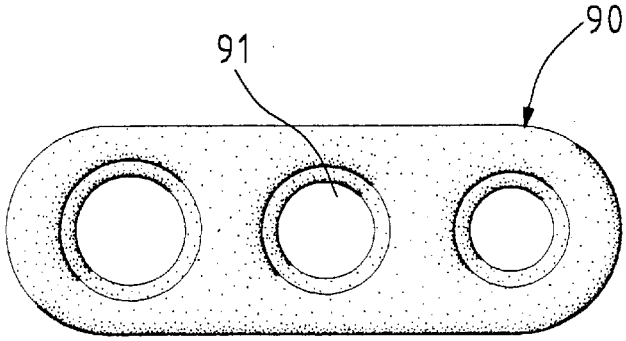
PRIOR ART Fig. 36
FIG. 36 is a top view of a tool holder according to prior art.
Figure 37:
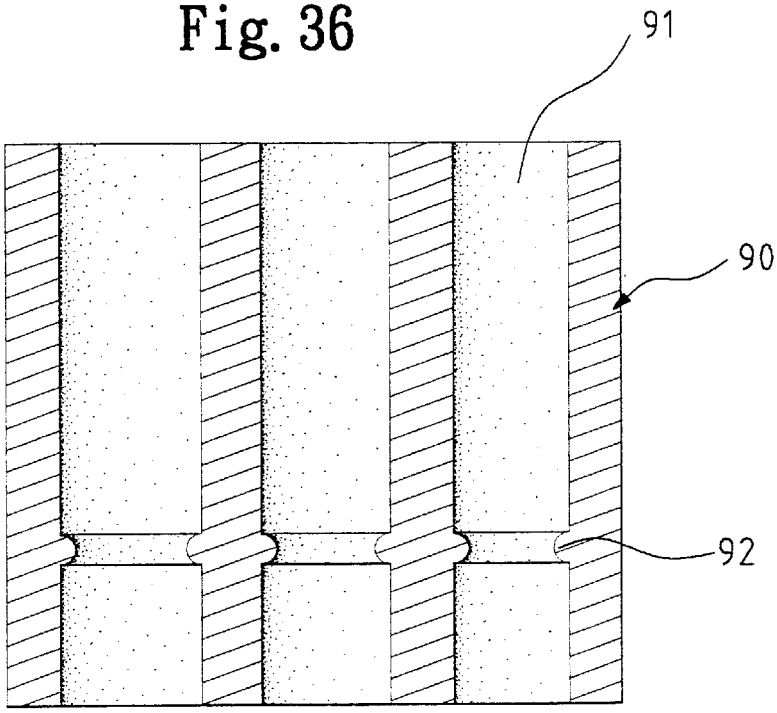
PRIOR ART Fig. 37
FIG. 37 is a sectional view of the tool holder in FIG. 36.

FIGS. 33 to 35 illustrate a ninth embodiment of the tool holder in accordance with the present invention. The tool holder is designated by reference numeral "90" and generally includes a plurality of spaced holes 91 defined therein. A cutout 93 is defined in a connecting wall that interconnects two adjacent holes 91. The cutout 93 may be extended to two lateral sides of the tool holder 90 to allow easy manufacture. As shown in FIG. 35, a periphery defining each cutout 93 includes a resilient retaining element 92 projected therefrom and having two branches, each branch having a portion 921 projecting inwardly into an associated hole 91. In this embodiment, each resilient retaining element 92 is substantially "Λ" shaped. In addition each of two lateral walls 931 that defines a portion of an associated cutout 93 and the associated resilient retaining element 92 have a slit 94 defined therebetween. Further, each branch of each resilient retaining element 92 includes a distal end 922 not connected with a periphery wall that defines a portion of the associated hole 91. Namely a slit 95 is defined between the distal end 922 of each branch of the resilient retaining element 92 and the periphery defining the associated hole 91. Further, in each of two outermost holes 91, a further cutout 923 is defined in the periphery that defines the associated hole 91, and a further resilient retaining element 924 is provided. Arrangement of the resilient retaining element 924 is similar to the resilient retaining element 42 (FIG. 13) to provide an additional holding effect.

In use, when a tool, e.g., a hexagonal wrench 100 is inserted into the hole 91, the resilient retaining elements 92 is slightly deformed and moved outwardly (FIG. 35) and may securely hold the hexagonal wrench 100. When the hexagonal wrench 100 is removed, the resilient retaining elements 92 return to their initial positions. It is appreciated that the cutouts 93 allow deformation of the resilient retaining element 92 without any damage or wear.

Although the embodiments illustrated are used for holding hexagonal wrenches, it is appreciated that the tool holders of the present invention can be used to hold all kinds of tools.

Although the invention has been explained in relation to its preferred embodiment, it is to be understood that many other possible modifications and variations can be made without departing from the spirit and scope of the invention as hereinafter claimed.

What is claimed is:

1. A tool holder comprising:

a plurality of spaced holes;

a connecting wall that interconnects two adjacent said holes having a cutout defined therein;

a periphery that defines each said cutout including a resilient retaining element projected therefrom, and each said resilient retaining element having a portion projected into one of the two adjacent said holes, wherein each said cutout is communicated with said two adjacent holes, and the resilient retaining element includes two branches respectively projected into the two adjacent holes and wherein the periphery that defines each said cutout includes two lateral walls, each said lateral wall and an associated said resilient retaining element having a slit defined therebetween.

2. The tool holder as claimed in claim 1, wherein each said resilient retaining element has a distal end, the distal end of each said resilient retaining element and the periphery of the associated said cutout having a second slit defined therebetween.

3. The tool holder as claimed in claim 1, wherein each of two outermost said holes includes a second cutout defined in an inner periphery thereof, a periphery that defines said second cutout including a second resilient retaining element projected therefrom, each said second resilient retaining element having a portion projected into an associated said outermost hole.

4. The tool holder as claimed in claim 1, wherein each of two outermost said holes includes a second cutout defined in an inner periphery thereof, a periphery that defines said second cutout including a second resilient retaining element projected therefrom, each said second resilient retaining element having a portion projected into an associated said outermost hole.

* * * * *